US005464094A

United States Patent [19]

La Haye

[11] Patent Number: 5,464,094

[45] Date of Patent: Nov. 7, 1995

[54] PACKAGING CONTAINER FOR STICK-ON LENSES ENABLING TESTING THEREOF WITHOUT REMOVAL FROM CONTAINER

[75] Inventor: Peter G. La Haye, Medina, Wash.

[73] Assignee: LaHaye Laboratories, Inc., Redmond, Wash.

[21] Appl. No.: 240,276

[22] Filed: May 10, 1994

[51] Int. Cl.[6] ..... A45C 11/04

[52] U.S. Cl. ..... 206/316.1; 206/5; 206/6

[58] Field of Search ..... 206/316.1, 5, 6; 224/257, 258

[56] References Cited

U.S. PATENT DOCUMENTS

| | | | |
|---|---|---|---|
| 2,461,792 | 2/1949 | Weaver | 206/6 X |
| 2,511,329 | 6/1950 | Craig | 206/6 |
| 2,642,987 | 6/1953 | Castelli | 206/6 |
| 2,666,521 | 1/1954 | Miller et al. | 206/6 |
| 3,033,359 | 5/1962 | Mercer | 206/5 X |
| 3,116,829 | 1/1964 | Pacelli | 206/5 |

FOREIGN PATENT DOCUMENTS

| | | | |
|---|---|---|---|
| 2526283 | 11/1983 | Italy | 206/6 |
| 0395470 | 7/1933 | United Kingdom | 206/6 |

*Primary Examiner*—Bryon P. Gehman
*Attorney, Agent, or Firm*—Gordon W. Hueschen

[57] ABSTRACT

A packaging container for self-adhering or stick-on lenses suitable for point-of-purchase display of such lenses which enables testing of the effectiveness and suitability of the stick-on lenses by a potential purchaser without removal of the stick-on lenses from the container in which packaged, which is essentially tamper-proof, and which may also serve as a convenient storage container or carrying case for the stick-on lenses. Stick-on lenses which may be conveniently displayed in a packaging container of the invention are such as may be adhered by autogenous or inherent adhesive characteristics to the interior surface of the lenses of a pair of sunglasses or like non-corrective spectacles.

22 Claims, 3 Drawing Sheets

PACKAGING CONTAINER FOR STICK-ON LENSES ENABLING TESTING THEREOF WITHOUT REMOVAL FROM CONTAINER

BACKGROUND OF THE INVENTION

1. Field of the Invention

Packaging containers for stick-on lenses which are suitable for point of purchase display thereof and which enable the testing of the stick-on lenses by a potential purchaser without removal of the lenses from the container in which packaged. Such packaging containers which make pilfering or theft more difficult and may be used as a convenient storage or carrying case.

2. Prior Art

There is no known prior art relating to packaging containers for stick-on lenses, much less which enable testing of the stick-on lenses by a potential user without removal of the lenses from the packaging container.

Recently stick-on lenses having considerable consumer appeal and market potential have been developed from aliphatic thermoplastics, so that aliphatic thermoplastic polyurethane press-on lenses and eyeglasses embodying the same are now or soon will be commercially available. These lenses are of optical clarity and can be adhered to base lenses, e.g., usual sunglass or other plano-type lenses, which themselves provide no correction but which may have normal built-in curvatures, by virtue of their autogenous or inherent adhesive properties. That is, adherence between the sunglass or other non-corrective lens and the stick-on lenses is effected by the molecular surface adhesion between the stick-on lens and the interior surface of the sunglass or other curved but in any event non-corrective lens to which adhered. Certain of these stick-on lenses are now projected to be available on the market shortly under the trademark "SUN-SIGHTS". These lenses may be extremely simple or more complex, but the most common are a reader or magnification type, which may for example have a built-in power of +1.0 d, all the way up to a +4.0 d, the "d" standing for diopters, and approximately +2.5 d being usual and generally satisfactory for incorporation into a reader-type lens by attachment of such a stick-on lens to the inner surface of a sunglass lens or other suitably curved plano lens.

Corrective lenses, for example for the correction of nearsightedness or myopia, are also available, and such lenses for the correction of nearsightedness or myopia representatively have a −2.00 diopter correction.

Bifocal lenses can also be provided and generally comprise an integral reader lens section attached at the lower portion of the base lens, plus an integral additional stick-on lens section thereabove, for example, a −1 diopter miopia-correction stick-on lens as a second power lens section, while the upper portion of the sunglass or other base lens is left uncorrected for adequate distance viewing. More complex lenses wherein the magnification or reader correction is representatively +3.75 diopters, a second meso or intermediate correction is +2.37 diopters, and an upper lens section provides a long range or distance correction of +1 diopter, are also possible. Moreover, reader or corrective stick-on lenses for suitably curved plano or sunglasses by inherent molecular surface adhesion may also be provided as separate as opposed to integral lenses for attaching to the base lens.

In any event, stick-on lenses are presently known and are or will soon be available commercially, so that some suitable packaging container, useful for point-of-purchase display thereof, and which may possibly also be used subsequently for storage thereof or as a carrying case therefor, are now of interest. The problem is a challenging one in view of the fact that stick-on lenses have not previously been marketed, at least not on any substantial commercial scale, so that not only adequate display of the stick-on lenses, but also some means of testing the same by the potential purchaser without removal of the stick-on lenses from the packaging container, and which would also make the stick-on lenses less likely to be pilfered or stolen, now becomes highly desirable and is accordingly provided by the present invention.

Suitable stick-on lenses, based upon poly-ether-based and poly-ester-based aliphatic thermoplastic polyurethanes, are known and are particularly suitable. Such are disclosed in greater detail, to the extent that the previous disclosure is not by itself fully adequate, in my prior-filed U.S. patent application Ser. No. 08/163,678, filed Dec. 7, 1993, the disclosure of which is incorporated herein and by reference made a part hereof.

OBJECTS OF THE INVENTION

It is an object of the present invention to provide packaging containers for stick-on lenses. Another object is to provide such packaging containers in which the stick-on lenses, when in place therein, are visible for inspection by a potential purchaser. A further object is the provision of such packaging containers which permit a potential purchaser to test the stick-on lenses for effectiveness and suitability from the standpoint of the potential purchaser without removal of the stick-on lenses from the packaging container in which displayed. A still further object of the invention is the provision of such a packaging container for stick-on lenses in which the stick-on lenses are displayed on a non-corrective but transparent surface or pane of the packaging container having a curvature which simulates that of a pair of sunglasses or other curved lens non-corrective spectacles and which container has a transparent flat or planar rear panel or pane which enables a prospective purchaser to look through the packaging container and test the stick-on lenses packaged therein in the same manner as if they were attached to the surface of a pair of sunglasses or other curved-lens non-corrective eyeglasses, e.g., the prospective purchaser's own pair of sunglasses. Additional objects will become apparent hereinafter and still further objects of the invention will be readily apparent to one skilled in the art to which this invention appertains.

SUMMARY OF THE INVENTION

What I believe and claim to be my invention, then, comprises the following, inter alia, singly or in combination:

A packaging container for stick-on lenses suitable for point-of-purchase display thereof which enables testing of the effectiveness and suitability of the said stick-on lenses by a potential purchaser without removal of the stick-on lenses from the container in which packaged, comprising an at least partially transparent three-dimensional box-like container having at least one set of opposed front and back panes, one of said panes having a curvature and the other pane being planar, the container being adapted to contain a stick-on lens adhered to the interior or posterior surface of the curved pane, in approximately the location it would occupy when stuck upon the inner surface of a lens of a pair of sunglasses, so as to enable viewing through a viewing area provided through said container extending from the planar pane through the curved pane to enable testing of the efficacy of said stick-on lens when said stick-on lens is stuck in place on the surface of said curved pane, said container being transparent at least in said viewing area; such a packaging container for stick-on lenses suitable for point-of-purchase display thereof which enables testing of the effectiveness and suitability of the said stick-on lenses by a potential purchaser without removal of the stick-on lenses from the container in which packaged, comprising an at least partially transparent three-dimensional box-like container having at least one set of opposed front and back panes, one of said panes being arcuate and having a curvature simulating the curvature of a lens of a pair of sunglasses, and the other pane being planar, the container being adapted to contain a stick-on lens adhered to the interior or posterior surface of the arcuate pane, in approximately the location it would occupy when stuck upon the inner surface of a lens of a pair of sunglasses, so as to enable viewing through a viewing area provided through said container extending from the planar pane through the arcuate pane to enable testing of the efficacy of said stick-on lens when said stick-on lens is stuck in place on the surface of said arcuate pane of said container, said container being transparent at least in said viewing area; such a packaging container having two sets of front and back panes, the two arcuate panes simulating both lenses of a pair of sunglasses; such a packaging container including a stick-on lens adhered in place on the interior surface of the said arcuate pane; such a packaging container including a plurality of stick-on lenses adhered in place on the interior surfaces of the said arcuate panes; such a packaging container having top and bottom and side walls; such a packaging container in which the entire container is constructed of plastic; such a packaging container having a nose aperture therein for more convenient viewing through the viewing area by placement of the packaging container near to the eyes with the nose aperture over the bridge of the nose; such a packaging container wherein the container is in the shape of a carrying case for a pair of eyeglasses; such a packaging container comprising ears with slots adapted to receive flaps of an advertising card therethrough, said tabs being secured to said advertising card; such a packaging container including an advertising card having top and bottom panels and wherein tabs on one panel extend through said slots and are secured between juxtaposed panels of said advertising card; such a packaging container wherein the stick-on lenses are reader lenses or lenses for the correction of myopia or nearsightedness; such a packaging container wherein the container is in the form of a plastic box with at least a portion thereof being transparent and optionally provided with a nose aperture to facilitate viewing therethrough; such a packaging container provided in two sections, a front section and a back section, including flanges on one section adapted to be press fit into engagement with the other section, thereby to form a completed box-like container; and such a packaging container wherein the arcuate or curved pane has a curvature approximating that of an arc of a circle having a radius of about 3.815 inches on its anterior surface and a curvature approximating that of an arc of a circle having a radius of about 3.715 inches on its posterior surface.

THE DRAWINGS

Reference is now made to the drawings for a better understanding of the invention, wherein.

DETAILED DESCRIPTION OF THE INVENTION

The materials of construction of the packaging containers of the present invention may be or comprise any suitable type of plastic which enables clear and preferably optical transparency in those areas of the packaging container in which transparency is required, as will be fully set forth hereinafter. Such suitable transparent plastics may be of any type already known in the art, such as polyethylene, polypropylene, acrylics, and copolymers of various types, the only requirements being that the plastic provide transparency in the required areas and sufficient rigidity so that the packaging container can withstand the usual handling of point-of-purchase display devices and containers without substantial damage and without breakage and without loss or dislodging of the stick-on lenses from their position within the packaging container wherein they are adhered on an inner surface simulating or approximating the curvature of the lenses of a usual pair of sunglasses or other non-corrective set of eyeglasses. For this purpose a plastic copolymer of butadiene and styrene known as a "K-resin"™, from Phillips Petroleum, is a preferred plastic, although crystal-clear polystyrenes, such as available from Huntsman, Calibre™ and Acrylite™ plastics made by molding plastic compounds from Cyro Industries, may be employed with equal or nearly equal facility, as long as the particular plastic is selected to have sufficient impact strength, transparency, and clarity.

The advertising card referred to hereinafter which forms a part of the present invention in certain of its embodiments may be of plastic sheet material or cardboard or paperboard of any suitable type, as is commonly employed in the area of audio and video tape, compact disc, and other similar point-of-purchase display packaging, according to usual practices of the display and advertising art, and when present will usually be suitably printed with advertising or product identification and explanation material and data or the like.

Figure 2:
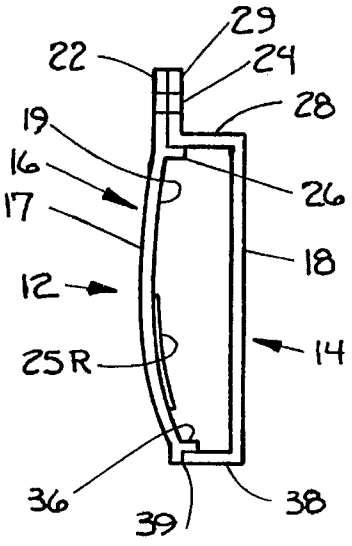
FIG. 2 is a cross-section taken along line 2—2 of FIG. 1.
Figure 1:
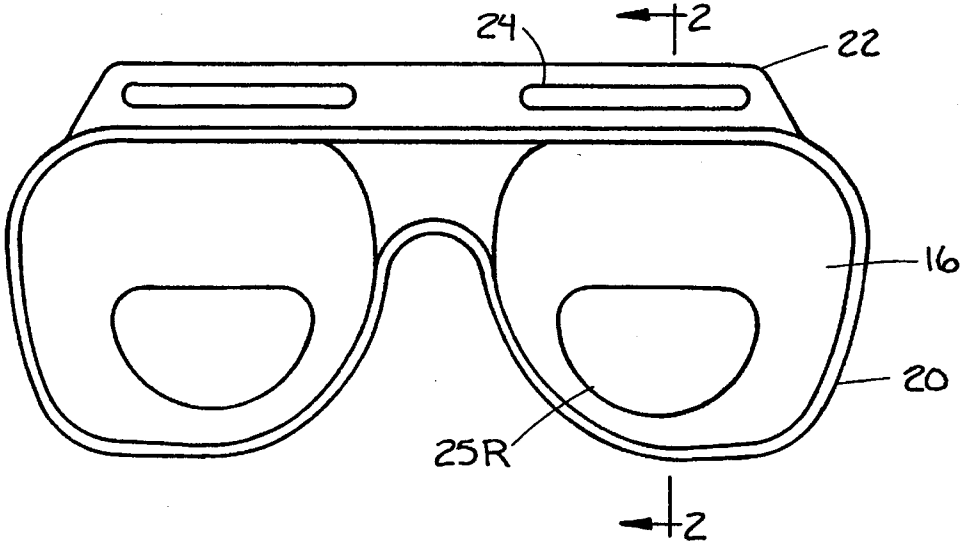
FIG. 1 is a top plan view of a packaging container of the invention for displaying reader-type stick-on lenses.
Figure 3:
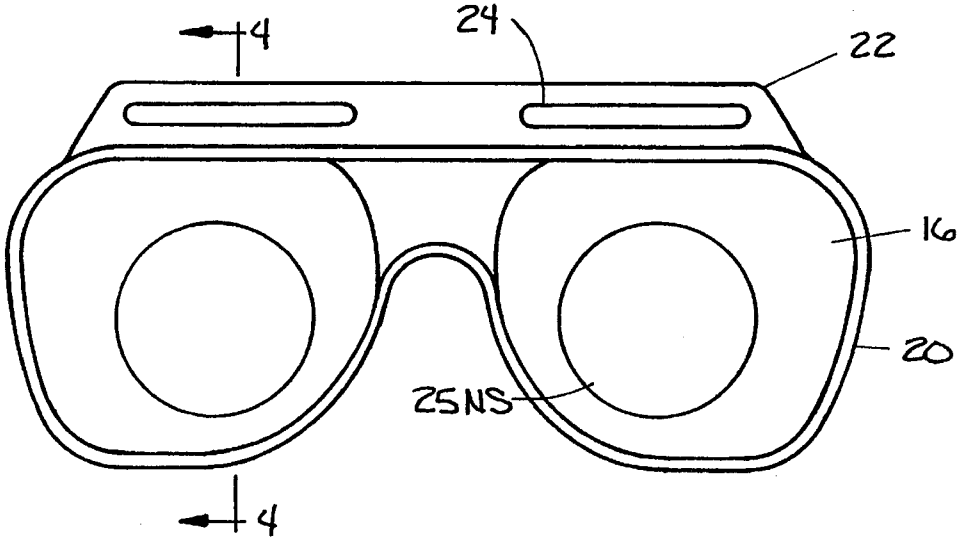
FIG. 3 is the same as FIG. 1, but adapted for the display of a corrective lens for nearsightedness or myopia.

Referring now to the drawings and to the figures thereof with greater particularity, a packaging container of the invention is generally shown in FIGS. 1 and 3 at 10. The difference between FIGS. 1 and 3 is that the stick-on lens in FIG. 1 is a reader lens 25R whereas, in FIG. 3, the stick-on lens provides a correction for nearsightedness or myopia and is designated 25NS. Otherwise, the structures of the packaging containers of FIGS. 1 and 3 are the same, as are their respective cross-sections as shown in FIGS. 2 and 4.

From FIGS. 1 and 3, the stick-on lens 25R or 25NS is immediately apparent, in each case attached, by its inherent or autogenous adhesive properties, to the posterior surface 19 of frontal pane 16 of the container 10, having sidewalls at 20 and frontal pane extension or tongue 22 provided with an elongated aperture or slot 24.

Figure 4:
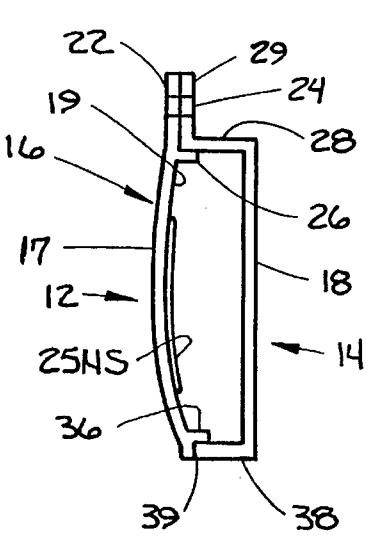
FIG. 4 is a cross-section taken along line 4—4 of FIG. 3.

The box-like structure of the embodiments of FIGS. 1 and 3 is more readily understood from the cross-sectional views of FIGS. 2 and 4, from which it is seen that the container comprises two (2) sections, a front section 12 and a rear section 14. Front section 12 comprises frontal pane 16 and rear section 14 comprises straight or planar rear pane 18. Rear section 14 also comprises top wall 28 and bottom wall 38 as well as top wall extension 29, top wall extension 29 having a common aperture 24 with frontal pane extension 22. In addition to frontal pane extension 22, frontal pane 16 has upper flange 26 and lower flange 36, for frictional press-fit engagement with top wall 28 and bottom wall 38 of rear section 14. Alternatively, front section 12 may be hinged at 39 with the bottom wall 38 of rear section 14, in which case upper flange 26 provides frictional engagement with top wall 28 for completing the box-like structure or enclosure of container 10 of the invention, as shown in FIGS. 1–4 in the shape of an eyeglass carrying case.

Frontal pane 16 has the stick-on lens 25R or 25NS, when packaged in container 10, adhered to the inner or posterior curved surface 19 thereof, the curved surface of frontal pane 16 having no corrective power without the presence of the stick-on lens, but having a curvature which approximates the curvature of a pair of lenses of a pair of sunglasses or other curved but non-corrective plano-type eyeglasses. Thus it may comprise an anterior surface 17 which has a curvature approximating that of an arc of a circle having a radius of about 3.815 inches and a posterior surface 19 which has a curvature approximating that of an arc of a circle having a radius of about 3.715 inches, these surfaces simulating the curvatures of the lenses of a pair of sunglasses or other non-corrective eyeglass lenses, and thereby giving the packaging container a transparent view-through area having no power without the presence of the stick-on lenses, since the rear pane 18, although also transparent with optical clarity, is a planar, i.e., straight or flat, pane with no corrective power whatever. Of course, the curvatures of sunglasses may vary widely, depending upon whether they are ordinary sunglasses or ski glasses or ski goggles, or any one of numerous available types but, regardless of the curvature thereof, the self-adhering stick-on lenses are applicable to and will adhere to the inner surface thereof, so that the curvature or degree of curvature of frontal pane 16 does not affect the operativeness of the present invention.

As will be readily seen from FIGS. 1 and 3, the stick-on lens 25R or 25NS adheres to the inner surface of the frontal panel 16 in each case by static cling or autogenous or inherent adhesion and, as will immediately be noted, the packaging container 10 may also readily serve as a convenient storage or carrying case for the consumer once the stick-on lenses have been purchased.

Moreover, it is a simple matter for the consumer to pick up the container 10 and place the nose recess of the simulated eyeglass case 10 package on the bridge of his or her nose for evaluation of the product performance and its suitability from the standpoint of the intended purchaser and user.

Figure 5:
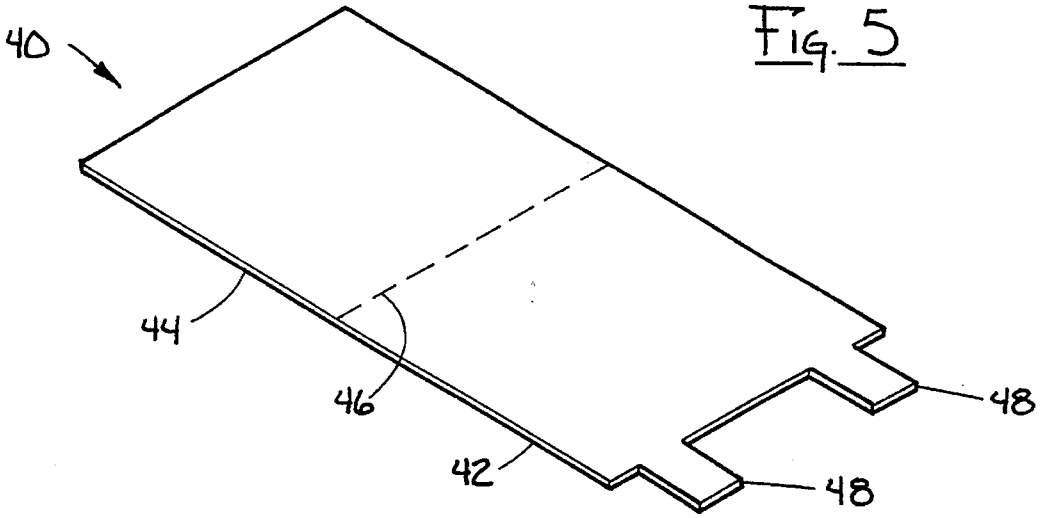
FIG. 5 is an isometric view of a sheet of plastic, cardboard, or paperboard adapted to be used as an advertising or identity card.

From FIG. 5 is seen a plastic, cardboard, or paperboard advertising or identification card shown generally in planar form at 40, having a bottom panel 42 and a top panel 44 separated by a line of weakness 46 which may be a fold or score line and having at the lower end of bottom panel 42 outwardly-extending tabs 48.

Figure 6:
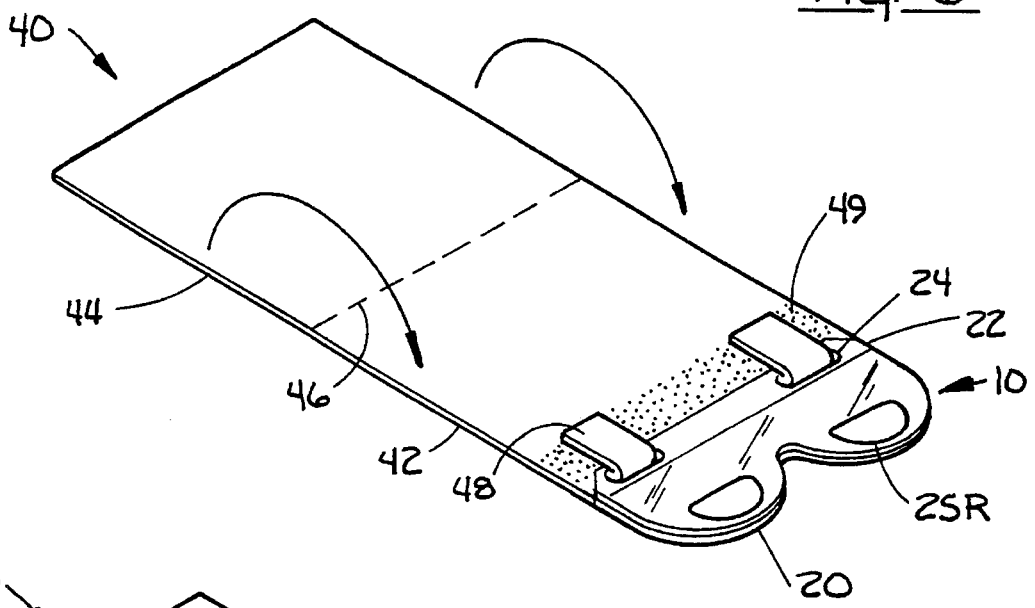
FIG. 6 is an isometric view of the card of FIG. 5, showing attachment of a packaging container of FIG. 1 thereto before folding over the card into a double-layered advertising card.
Figure 7:
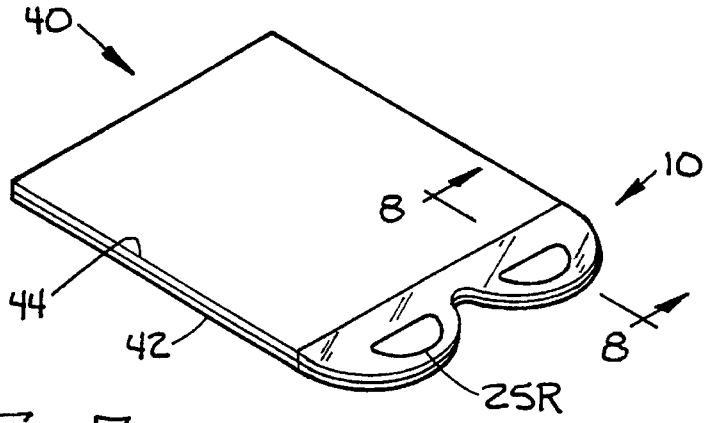
FIG. 7 is an isometric view of the finished product after folding the advertising card of FIGS. 5 and 6 upon itself to provide a double-layered advertising card incorporating the packaging container structure of FIG. 1 securely therein.

As shown in FIG. 6, attachment of the packaging container 10 of the invention to the advertising card 40 is readily effected by inserting tabs 48 through apertures 24 in extension or tongue 22 and then folding tabs 48 back upon adhesive or glue area 49 provided on the adjacent area of the upper surface of bottom panel 42.

Figure 8:
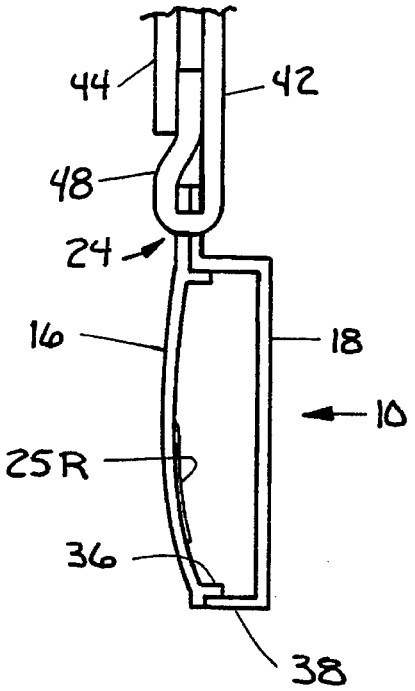
FIG. 8 is a cross-section of the completed packaging container embodiment of FIG. 7 taken along the line 8—8 of FIG. 7.

Top panel 44 is then swung along line of weakness 46 into juxtaposition superposed atop bottom panel 42, whereupon a complete double-layered advertising card 40 having bottom panel 42 and upper panel 44 is provided, with upper panel 44 secured by means of adhesive 49 to the upper surface of bottom panel 42 and enclosing securely tabs 48 between bottom and top panels 44 and 42, with stick-on lens packaging container 10 now securely connected to the completed advertising card 40 so that stick-on lenses 25R cannot be removed from the packaging without destroying packaging container 10 and/or the completed advertising card 40 securely connected thereto, as shown in the cross-sectional view of FIG. 8. Staples or like fasteners may also be employed or additionally employed to ensure securement of tabs 48 between panels 44 and 42 and of the panels to each other.

Figure 10:
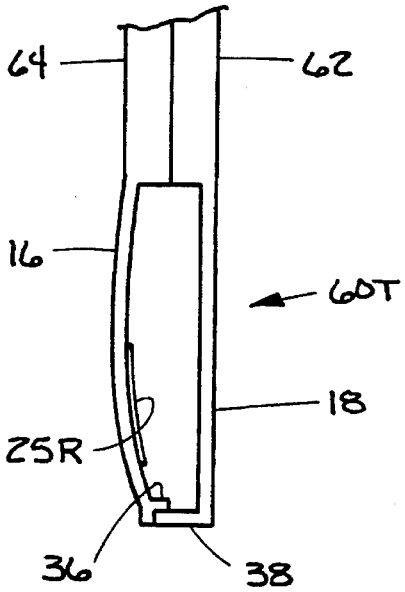
FIG. 10 is a cross-section of that portion of the embodiment of FIG. 9 taken along line 10—10 of FIG. 9.
Figure 9:
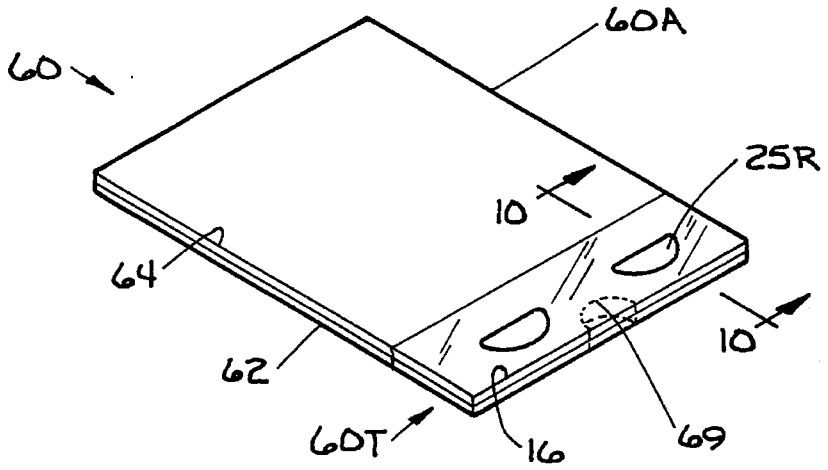
FIG. 9 is an isometric view of another embodiment of the packaging container of the invention in the form of a relatively thin flat-box.

FIG. 9 shows another embodiment of the invention generally at 60, wherein the flat box-like packaging container is in two sections, top and bottom, both entirely of plastic, section 60A of which may or may not be transparent, painted, or colored, or transparent with an advertising or identification card located therebeneath. The lower portion 60T, however, must be of transparent plastic and incorporates a frontal pane 16 having approximately the same curvatures on posterior and anterior surfaces 19 and 17 as set forth with regard to previous embodiments shown in FIGS. 1–4 at 10. Plastic container 60 therefore comprises bottom and top plastic segment 62 and 64, having suitable flanges for a press fit together which may be further secured by adhesive, and the bottom portion of which 60T must be of planar transparent plastic, both for its curved front pane 16 and its rear planar, i.e., straight or flat, transparent pane 18, just as shown in FIGS. 2 and 4, and visible in FIG. 10. Stick-on lenses 25R are shown in place adhered on the inner or posterior surface 19 of curved frontal pane 16, and an optional nose recess for viewing through the transparent portion 60T of the container 60 is shown in phantom lines at 69. A cross-sectional view of this embodiment of the invention is shown in FIG. 10.

OPERATION

In operation, the potential user, consumer, customer, or purchaser simply picks up the packaging container of the invention and places it before his or her eyes, using the nose aperture in those embodiments where the same is provided, and looks or views through the clear transparent packaging and through the stick-on lenses adhered to the posterior or inner surface of the frontal pane thereof, when the stick-on lenses are in place therein. By applying the container, which houses the stick-on lenses in a transparent see-through portion thereof, to small print or any other object within the line of sight and by varying the distance of the packaging container therefrom, the potential purchaser is able to test and determine for himself or herself the efficacy of the stick-on lenses as packaged in the packaging container of the invention, and thereby determine the suitability of the stick-on lenses for the particular use and correction intended and desired by the potential purchaser. After purchase, the stick-on lenses can be removed only by destroying the attached advertising card or the packaging container itself, except where provision is made for reuse or continued use as a storage container or carrying case by providing removable securement means such as adhesive, tape, clips, or the like, all as is well-known in the art.

It is thus seen that a novel and unique packaging container for stick-on lenses which adhere to the surface of non-corrective lenses such as sunglass lenses and the like by virtue of their autogenous or inherent adhesive properties has been provided by the present invention and, moreover, such a packaging container as is not only suitable as a point-of-purchase display container but which also enables a prospective customer to examine the product for its effectiveness and suitability from the standpoint of the prospective purchaser without removal of the stick-on lenses from the container in which packaged, and which moreover should eliminate or minimize pilfering or theft of the stick-on lenses when on display in the packaging container of the invention, and which may if desired be employed as a suitable storage or carrying case for the stick-on lenses, have all been provided by the present invention, whereby all of the objectives of the present invention have been attained.

It is to be understood that the present invention is not to be limited to the exact details of operation, or to the exact compounds, compositions, methods, procedures, or embodiments shown and described, as various modifications and equivalents will be apparent to one skilled in the art, wherefore the present invention is to be limited only by the full scope which can be legally accorded to the appended claims.

I claim:

1. A packaging container for stick-on lenses suitable for point-of-purchase display thereof which enables testing of the effectiveness and suitability of the said stick-on lenses by a potential purchaser without removal of the stick-on lenses from the container, comprising an at least partially transparent three-dimensional container having a set of opposed front and back panes, said front pane having an outward curvature and said back pane being planar, the container being adapted to contain a stick-on lens adhered to the interior surface of the curved pane, so as to enable viewing through a viewing area provided through said container extending from the planar pane through the curved pane and thus to enable testing of the efficacy of said stick-on lens when said stick-on lens is stuck in place on the surface of said curved pane, said container being transparent at least in said viewing area, and including a stick-on lens adhered in place on the interior surface of said curved pane.

2. A packaging container of claim 1, having top and bottom and side walls.

3. A packaging container of claim 1, having a nose aperture therein for more convenient viewing through the viewing area by placement of the packaging container near to the eyes with the nose aperture over the bridge of the nose.

4. A packaging container of claim 1, wherein the container is in the form of a plastic box with at least a portion thereof being transparent and optionally provided with a nose aperture to facilitate viewing therethrough.

5. A packaging container of claim 1, wherein a pane of the packaging container is transparent with optical clarity.

6. A packaging container of claim 1 for stick-on lenses, wherein the front pane is arcuate and has a curvature simulating the curvature of a lens of a pair of sunglasses.

7. A packaging container of claim 6, including a stick-on lens adhered in place on the interior surface of the said arcuate pane.

8. A packaging container of claim 6, in which the entire container is constructed of plastic.

9. A packaging container of claim 6, wherein the container is in the shape of a carrying case for a pair of eyeglasses.

10. A packaging container of claim 6, wherein the container has a nose aperture for convenient placement of the packaging container upon the bridge of the nose to facilitate viewing therethrough.

11. A packaging container of claim 6, provided in two sections, a front section and a back section, including flanges on one section adapted to be press fit into engagement with the other section, thereby to form a completed container.

12. A packaging container of claim 6, wherein the curved pane has a curvature approximating that of an arc of a circle having a radius of about 3.815 inches on its anterior surface and a curvature approximating that of an arc of a circle having a radius of about 3.715 inches on its posterior surface.

13. A packaging container of claim 6, wherein a pane of the packaging container is transparent with optical clarity.

14. A packaging container of claim 6, having two sets of front and back panes, the two arcuate front panes simulating both lenses of a pair of sunglasses.

15. A packaging container of claim 3, including a plurality of stick-on lenses adhered in place on the interior surfaces of the said arcuate panes.

16. A packaging container of claim 15, wherein the stick-on lenses are reader lenses or lenses for the correction of myopia or nearsightedness.

17. A packaging container of claim 14, wherein the container is in the shape of a carrying case for a pair of eyeglasses.

18. A packaging container of claim 17, comprising ears with slots adapted to receive flaps of an advertising card therethrough, said flaps being secured to said advertising card.

19. A packaging container of claim 18, including an advertising card having top and bottom panels and wherein flaps on one panel extend through said slots and are secured between juxtaposed panels of said advertising card.

20. A packaging container of claim 14, wherein the container has a nose aperture for convenient placement of the Packaging container upon the bridge of the nose to facilitate viewing therethrough.

21. A packaging container of claim 14, provided in two sections, a front section and a back section, including flanges on one section adapted to be press fit into engagement with the other section, thereby to form a completed container.

22. A packaging container of claim 14, wherein each arcuate pane has a curvature approximating that of an arc of a circle having a radius of about 3.815 inches on its anterior surface and a curvature approximating that of an arc of a circle having a radius of about 3.715 inches on its posterior surface.

* * * * *